US006405784B2

(12) United States Patent
Takizawa et al.

(10) Patent No.: US 6,405,784 B2
(45) Date of Patent: Jun. 18, 2002

(54) INJECTION MOLDING METHOD OF METAL MOLD

(75) Inventors: Kiyoto Takizawa; Toshiyasu Koda; Yuji Hayashi; Mamoru Miyagawa, all of Nagano-ken (JP)

(73) Assignee: Nissei Plastic Industrial Co., Ltd., Nagano-Ken (JP)

( * ) Notice: Subject to any disclaimer, the term of this patent is extended or adjusted under 35 U.S.C. 154(b) by 0 days.

(21) Appl. No.: 09/845,049

(22) Filed: Apr. 27, 2001

(30) Foreign Application Priority Data

Apr. 28, 2000 (JP) ..... 2000-130820

(51) Int. Cl.[7] ..... B22D 13/00; B22D 27/09; B22D 17/04; B22D 17/08; B22C 9/00

(52) U.S. Cl. ..... 164/113; 164/900; 164/312

(58) Field of Search ..... 164/900, 113, 164/312

(56) References Cited

U.S. PATENT DOCUMENTS 5,040,589 A * 8/1991 Bradley et al. ..... 164/113
5,501,266 A * 3/1996 Wang et al. ..... 104/113
6,283,197 B1 * 9/2001 Kong ..... 164/312

* cited by examiner

*Primary Examiner*—M. Alexander Elve
*Assistant Examiner*—Kevin McHenry
(74) *Attorney, Agent, or Firm*—Weingarten, Schurgin, Gagnebin & Lebovici LLP

(57) ABSTRACT

The invention has an object to permit to mold metal molds having a thixothropic structure by melting, agitating and weighing, injection molten metal in a melting vessel by combining separately functioning agitation means and injection means. The invention consists in supply granular metal material in a fusion vessel 11 having a weighing chamber 17 by a cylinder of required length communicating with a nozzle port at the extremity section, including rotatively an agitation means 21 inside, and wherein an injection means 22 whose extremity section is formed into an injection plunger 30 is inserted advanceably and retractably into the center section of this agitation means 21. The metal material is heat melted by an external heat. The molten metal material is accumulated in the fusion vessel by homogenizing by the agitation means 21. A part of molten metal material is injection charged into a die at a temperature equal or superior to the solid phase line temperature and equal or inferior to the liquid phase line temperature, and molded into a metal mold having a thixothropic structure.

2 Claims, 3 Drawing Sheets

INJECTION MOLDING METHOD OF METAL MOLD

BACKGROUND OF THE INVENTION

1. Field of the Invention

The present invention concerns a method for injection molding a metal mold by melting low fusion point metal materials such as zinc, magnesium or their alloys.

2. Detailed Description of the Prior Art

Die casting is adopted for casting low fusion point non-ferrous metal; however, die casting requires a smelter for melting metal material completely, and the casting is performed by pumping molten metal from this smelter, or by extruding by a plunger. Therefore, granular metal material supplied from the rear of a heating cylinder is being melt by transporting forward in the heating cylinder by screw rotation, accumulated and weighed in a heating cylinder antechamber, injected and charged into a die from a nozzle at the heating cylinder extremity by screw advancement, similarly as plastic material, without melting by a smelter.

Problems encountered in case of adopting such injection molding for metal material are difficulty of melting and transport of metal material by screw rotation and weighing instability.

Plastic material is melt mainly by shearing heat generation; therefore, the screw diameter is formed to increase as approaching the extremity section, and the screw groove forming the material flow gap is formed relatively shallow. However, molten plastic is transported smoothly forward by screw rotation even when the flow gap is formed narrow, because of the difference of friction factor at the interface surface of the heating cylinder inner wall.

On the other hand, the viscosity of metal material completely molten to the liquid phase state being incomparably lower than the plastic material, there is almost no difference of friction factor at said two interface surfaces, so the transport power by screw rotation as in case of molted plastic generates hardly. In addition, in a low viscosity liquid phase state, a pressure elevation so strong as pushing back the screw does not generate, and the screw retraction by the material pressure hardly occurs, and the accumulated amount in the antechamber differs only by the screw rotation, making technically difficult to quantify the injection filling quantity.

Therefore, it has been proposed to injection molding a metal material in semi-molten state by limiting the melting temperature to a temperature equal or superior to the solid phase line temperature and equal or inferior to the liquid phase line temperature, without melting the metal material completely. In said temperature range, the structure of molten metal is supposed to be in semi-molten state (thixothropic state), and in this state, the flow resistance generates in the molten metal, allowing to transport by the screw rotation and to weigh by its retraction. Consequently, the molding of metal molds by the conventional injection molding has been performed adopting such method.

However, such molding method is nothing but a straight application of plastic material injection molding means, and it is difficult to maintain the molten metal temperature in the heading cylinder, as the metal is high in the heat conductivity different from plastic material. Even in the metal material molding, the heating cylinder keeps the set temperature being heated by an outer periphery band heater. However, the screw side has no heating means, and moreover, heat is easily radiated from the rear end section.

Consequently, the temperature of molten metal in the screw grooves becomes easily irregular and this can not be preventing by the agitation by screw rotation is assumed to be impossible, because the screw per se serves as molten metal material transport member, and provokes an excessive supply of material.

This invention devised to solve the aforementioned problems in case of injection molding of metal material in semi-molten state has an object to provide a novel injection molding method allowing to agitate molten metal in a melting vessel by combining separately functioning agitation means and injection means without adopting a screw having triple functions of melting, transport and injection supposed to be indispensable in the prior art, and to mold metal molds having a thixothropic structure in a state where the metal material melting temperature is kept within a set temperature range by this.

SUMMARY OF THE INVENTION

For the aforementioned object, this invention consists in supply continuously or discontinuously granular metal material in a cylindrical fusion vessel having a required length of weighing chamber communicating with a nozzle port at the extremity section, including rotatively an agitation means inside, and where an injection means whose extremity section is formed into an injection plunger is inserted advanceably and retractably into the center section of this agitation means, for engaging slidably said injection plunger into the weighing chamber, heat melting the metal material to a temperature equal or superior to the liquid phase line temperature by an external heat and, at the same time, accumulating in the fusion vessel by homogenizing by the aforementioned agitation means, injecting and filling a die by cooling to a temperature equal or superior to the solid phase line temperature and equal or inferior to the liquid phase line temperature in the course from the feed into the weighing chamber by the retraction of the aforementioned injection plunger to the injection and filling of the die, and forming into a metal mold having a thixothropic structure.

Also, this invention consists in supply continuously or discontinuously granular metal material in a cylindrical fusion vessel having a required length of weighing chamber communicating with a nozzle port at the extremity section, including rotatively an agitation means inside, and where an injection means whose extremity section is formed into an injection plunger is inserted retractably into the center section of this agitation means, for engaging slidably said injection plunger into the weighing chamber, heat melting the metal material to a temperature equal or superior to the solid phase line temperature and equal or inferior to the liquid phase line temperature by an external heat and, at the same time, accumulating in the fusion vessel by agitating and maintaining melt metal material in a semi-melt state (thixothropy state) by the aforementioned agitation means, sending a part of this semi-melt state metal material into the weighing chamber by the retraction of the aforementioned injection plunger, injecting and filling by advancing the injection plunger keeping the semi-melt state event after the weighing, and forming into a metal mold having a thixothropic structure.

DETAILED DESCRIPTION OF THE PREFERRED EMBODIMENT

Figure 1:
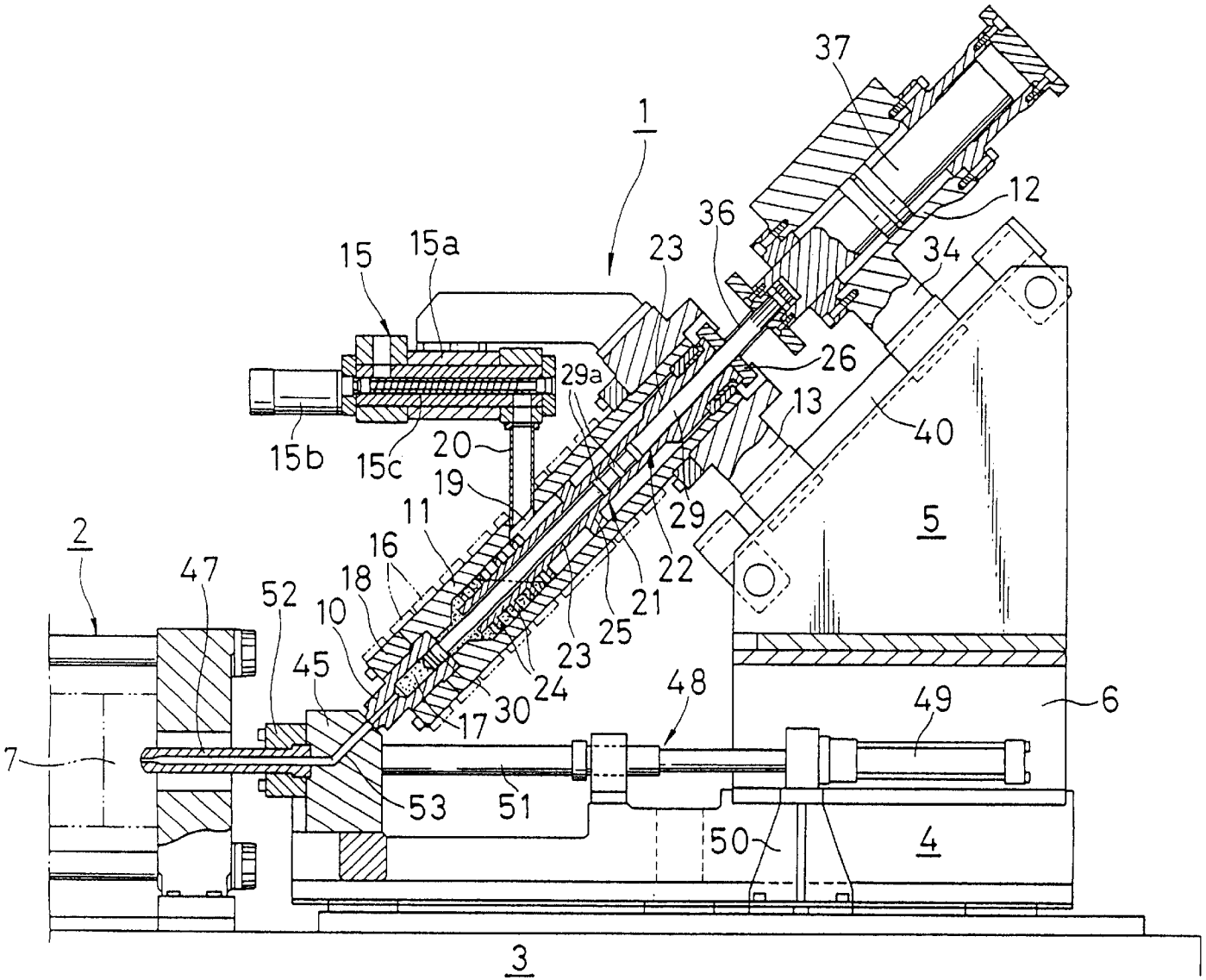
FIG. 1 is a schematic longitudinal side view of a molding machine allowing to realize the metal mold injection molding method according to the present invention.
Figure 2:
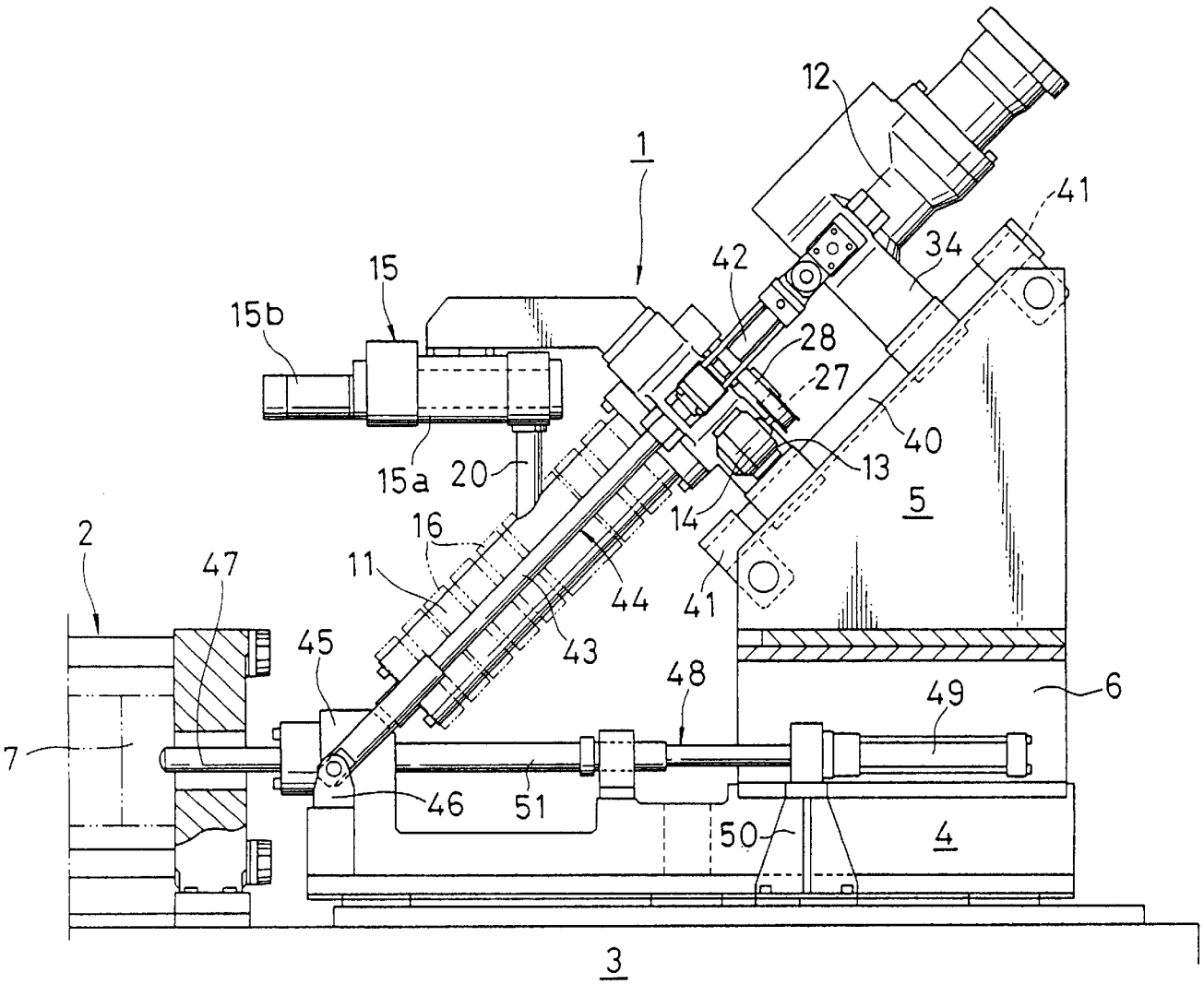
FIG. 2 is also a side view shown a partial longitudinal section.
Figure 3:
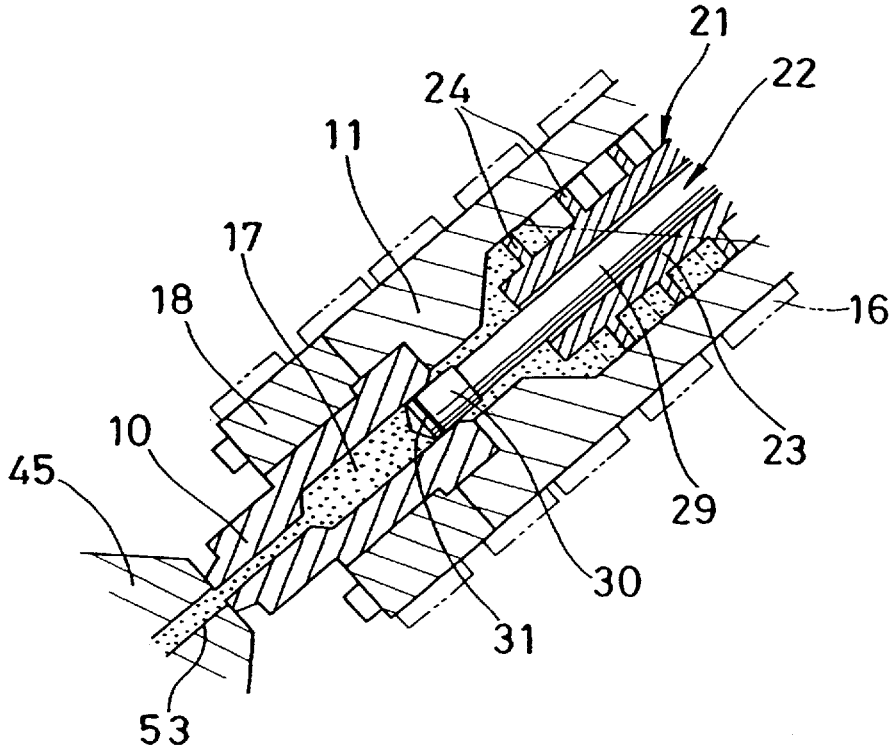
FIG. 3 is a longitudinal side view of the melting cylinder extremity section when the injection plunger is retracted.
Figure 4:
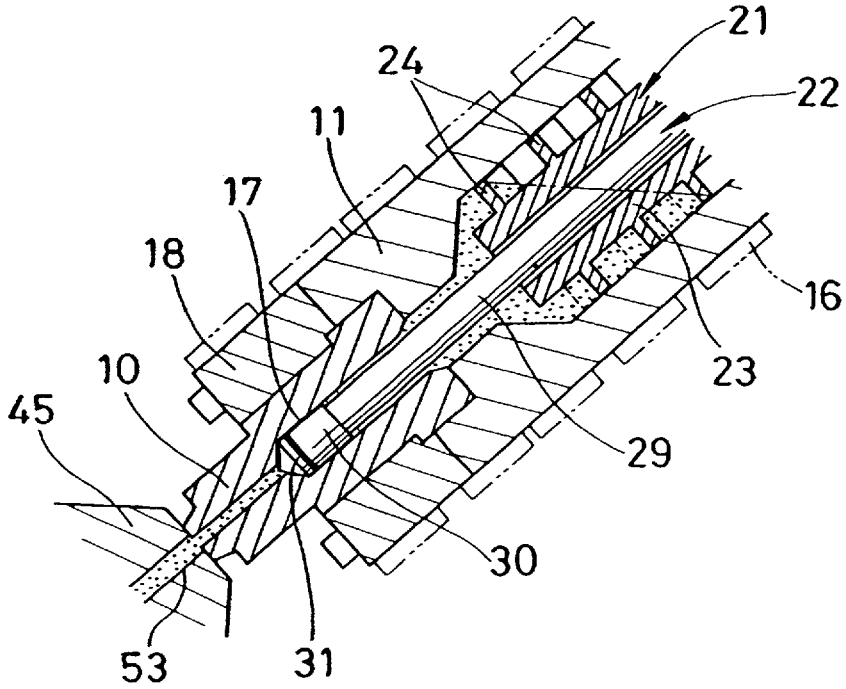
FIG. 4 is a longitudinal side view of the melting cylinder extremity section when the injection plunger is advanced.

Drawing show one embodiment of molding machine allowing to exert the metal mold injection molding method according to the present invention.

In the drawing, 1 is an injection mechanism, 2 is a compression mechanism, both installed on a top face of a base 3 is a pedestal 4 installed movably forward and backward in respect of the compression mechanism 2 and provided with a trestle 5 having a slant top face and mounted rotatably on the rear section thereof, and the aforementioned injection mechanism 1 is installed on this trestle 5 so that the nozzle side can be positioned downwardly slant in respect of the compression mechanism 2.

The aforementioned injection mechanism 1 comprises a cylindrical melting cylinder 11 constituting the metal material melting vessel, an agitation and injection means therein mentioned below, a injection cylinder 12 provide at the rear end section of the melting cylinder 11 with an interval, an electric motor 14 for agitation attached to the support leg 13 at the rear end bottom of the melting cylinder 11, and a delivery equipment 15 for supplying granular metal material in the melting cylinder. This delivery equipment 15 comprises a horizontal cylinder 15*a* and an inner screw shaft 15*c* rotating by an electric motor 15*b* provide at the cylinder end section. Though not shown in the drawing, it comprises a structure allowing to mount a heater for material pre-heating around the cylinder as necessary.

The aforementioned melting cylinder 11 is provided with a nozzle member 10 at the extremity and a band heater 16 around the outer periphery. The inside of the extremity section of the melting cylinder 11 communicating with the aforementioned nozzle member 10 nozzle port is formed in a required length cylindrical weighing chamber 17 whose diameter is reduced than the melting cylinder 11 inner diameter. In the illustrated example, the rear section inside diameter of the nozzle member 10 attached to the melting cylinder extremity by an extremity member 18 is reduced than the melting cylinder inner diameter, and this rear section inside is formed as a weighing chamber 17 in communication with the melting cylinder inside; however, according to the case, a structure wherein the extremity member 18 inner diameter is reduced to form the weighing chamber 17, and a nozzle tip is attached to the extremity member 18 thereof.

A supply port 19 is opened at the middle top of the melting cylinder 11 provided with such weighing chamber 17 at the extremity, and the aforementioned delivery equipment 15 is arranged at this supply port 19 by connecting a piping 20. The rear end of the melting cylinder 11 is in the open state, and an agitation member 21 and an injection member 22 composing the aforementioned agitation and injection means is installed inside therefrom.

The aforementioned agitation member 21 is made of a rotation shaft wherein a plurality of agitation fins 24, 24 are formed continuously around the extremity section outer circumference of a hollow shaft section 23 at the fixed position having a through port in the middle. These agitation fins 24, 24 have an external diameter substantially equal to the melting cylinder 11 inner diameter. A partition flange 25 serving also as guide in contact with the inner circumferential surface of the melting cylinder 11 is integrally formed around the shaft section backward of the hollow shaft section 23 agitation fin 24.

A pulley 26 is affixed to the end section of the aforementioned hollow shaft section 23 protruding from the opening end of the melting cylinder 11, a timing belt 28 is engaged over this pulley 26 and a pulley 27 at the driving shaft end of the aforementioned electric motor 14, the agitation member 21 turns unilaterally or reciprocally in the melting cylinder by the electric motor 14, allowing to agitate the molten metal by the aforementioned agitation fins 24, 24.

The aforementioned injection member 22 comprises an injection rod 29 inserted into said hollow shaft section 23 through port and provide slidably at the middle of the agitation member 21, and an injection plunger 30 attached to the extremity thereof, protruded from the front face of the agitation member 21 and fitted with the aforementioned weighing chamber 17. This injection plunger 30 moves forward and backward without exiting the weighing chamber inside by the injection rod 29. Rings 29*a* serving also to prevent backflow of molten metal penetrated into the rod guide and clearance are formed in several stages around the outer periphery of the injection rod 29 above the aforementioned partition flange 25.

The aforementioned injection plunger 30 is made of an outer diameter allowing to be inserted in the weighing chamber 17 with a clearance for sliding and provided with a seal ring 31 around the outer periphery thereof. This seal ring 31 comprises one adopting a heat resistant piston ring made of special steel of the like as it is. Though the detail is omitted in the drawing, the seal ring 31 is fitted to the annular groove around the plunger outer periphery providing a required gap between the groove bottom and the groove wall, so as to decrease the diameter during the weighing chamber side negative pressure by the plunger retraction, thereby increasing the aforementioned clearance to make suction transport of molten metal material into the weighing chamber smooth and, on the contrary, to prevent the backflow of molten metal from the aforementioned clearance by expanding by the weighing chamber side material pressure.

The aforementioned injection cylinder 12 includes integrally a support leg 34 at the cylinder front end bottom, this injection cylinder 12 is coupled integrally with the aforementioned melting cylinder 11 by tie bars 36 arranged at both sides leaving an interval, while the piston 37 is coupled with the aforementioned injection rod 29 rear end protruding from the aforementioned hollow shaft section 23 rear end, and moves forward and backward the injection rod 29 with the injection plunger 30 at the extremity.

Such injection cylinder 12 and the aforementioned melting cylinder 11 insert the end section of the aforementioned support legs 13, 34 protruding at respective lower both sides into support shafts 40, 40 juxtaposed at both sides of the aforementioned trestle 5 slant top surface and are mounted with the nozzle member 10 downward at the bottom, thereby composing the aforementioned injection mechanism 1 installed slant to the aforementioned compression mechanism 2.

Moreover, at both sides of the injection mechanism 1, a nozzle touch equipment 44 by a hydraulic cylinder 42 and an extended shaft rod 43 axially and rotatively attaches the rod 43 extremity to bearing members 46 at both sides of a nozzle touch block 45 erected at the middle of the pedestal 4 extremity, while a hydraulic cylinder 42 is bridged between the melting cylinder rear end and the injection cylinder front end, and the cylinder rear end is installed by rotatively affixing to the injection cylinder. This nozzle touch equipment 44 functions also as retraction equipment during repair or maintenance of the injection mechanism 1.

The aforementioned trestle 5 is formed into an inward slant surface whose top face has an angle of around 45 and the aforementioned support shaft 40 is attached to the top face thereof by members 41, 41 at both sides. This trestle 5 is, though omitted in the drawing, put on and fixed to a gate type reception base 6 installed on the aforementioned pedestal rest end section, and a nozzle touch equipment 48 of a nozzle member 47 installed horizontally by a member 52 on the nozzle touch block 45 front face is arranged from the reception base 6 inside middle to the aforementioned nozzle touch block 45.

A hydraulic cylinder 49 of this nozzle touch equipment 48 is fixed to a reception member 50 at the center inside the pedestal 4 installed on the machine base 3, a rod member 51 coupled to an inside piston rod (the drawing omitted) has an extremity coupled to the aforementioned nozzle touch block 45, the pedestal 4 moves forward and backward with the injection mechanism 1 on the trestle 4 top face by this rod member 51 forward and backward displacement, performing the nozzle touch to a mold 7 of the aforementioned nozzle member 47.

The inside upper section of the aforementioned nozzle touch block 45 is formed on a slant rear face positioned normal to the axial line of the aforementioned injection mechanism 1 nozzle member 10, a gate for nozzle touch is opened on the slant rear face. A hot runner 53 communicating the aforementioned nozzle member 47 and the injection mechanism 1 nozzle member 10 is formed in curvature inside the nozzle touch block 45, thereby preventing molten metal from leaking during the injection filling, by realizing a closely tight nozzle touch, even if the injection mechanism 1 is installed slant to the composition mechanism 2.

In order to form a metal mold, for instance a mold of magnesium (AZ91D) by a first injection molding method of the present invention using a molding equipment of the aforementioned composition, first the melting cylinder 11 is heated to a set temperature equal or superior to the liquid line temperature (620° to 680° C.) by a outer circumferential band heater 16, to heat the inside to a hot temperature equal or superior to the fusion temperature. On the other hand, the nozzle touch block 45 and the nozzle member 47 are also preheated, though omitted in the drawing, by an external heater to a temperature equal or inferior to the solid phase line temperature (470° C.) and equal or inferior to the liquid phase line temperature (595° C.) while molten metal material passes through the runner and is injected and charged in the mold 7. At this time, the space area in the delivery equipment shall be inactive gas atmosphere. This inactive gas can be supplied, though omitted in the drawing, for instance by connecting a supply pipe of an inactive gas cylinder to the aforementioned piping 20.

Next, the hollow shaft section 23 is rotated by the aforementioned electric motor 14 at a set speed to realize the agitation state. There, granular magnesium as metal material is supplied into the melting cylinder 11 from the supply inlet 19 by the aforementioned delivery equipment 15. As the melting cylinder 11 is slant downward, immediately the metal material melts in the area of agitation fins 24, 24 rotating with the hollow shaft section 23 becomes molten metal. Metal material supplied further continuously falls into the molten metal accumulated therein, melts by the heat of molten metal, and is mixed into the molten metal by the agitation fins 24, 24. This allows to melt in an extremely short time and, at the same time, the molten metal material is homogenized.

When the injection plunger 30 is in its advance position, the molten metal material is accumulated as it is in the front section of the melting cylinder 11. This accumulation amount of 10 shots or so is enough, and a continuous molding can be executed without problem by supplying material for one shot per molding.

When a predetermined amount of molten metal material is accumulated, the aforementioned injection plunger 30 is retracted. This retraction displacement is limited to a range where the seal ring 31 remains in the weighing chamber 17, and a part of accumulated molten metal material flows into the weighing chamber 17.

Molten metal material flows into the weighing chamber 17 by the negative pressure generated by the retraction displacement of the injection plunger 30 in the extremity member. This is because the previous injection molten metal material cools down and sets at the nozzle member 47 nozzle port, remains as cold plug, blocks the weighing chamber 17 nozzle side and prevents from flowing in from the nozzle port. In such a state, if a retraction force is applied to the injection plunger 30 at the advance limit, a negative pressure is generated in the weighing chamber 17 being expanded according to the retraction displacement.

This negative pressure reduced the diameter of the injection plunger 30 seal ring 31 and, at the same time, molten metal material flows from the clearance around the seal ring into the weighing chamber 17 being expanded by the suction effect of the negative pressure and fills the chamber. This prevents such a high negative pressure that the injection plunger 30 forced retraction becomes difficult from generating in the weighing chamber 17, allowing to weigh the material by a smooth retraction displacement of the injection plunger 30.

Consequently, a set amount of molten metal material can always be injected and charged in the die 7, by setting the weighing completion position anticipating the backflow amount by the advance displacement during the injection by the injection plunger 30, thereafter, changing the process to the injection filling, and advancing the injection plunger 30 to the advance limit.

From such material weighing, molten metal material is agitated continuously by the rotation of the aforementioned agitation fins 24, 24 even during the injection filling, because the aforementioned agitation member 21 and the injection member 22 are separate ones, thereby allowing to homogenize molten metal material in the melting cylinder, even when new metal material is supplied continuously or discontinuously into the melting cylinder 11.

It is unnecessary to make a large diameter injection rod as the conventional screw taking the rotation torque into consideration, because the injection member 22 does not rotate for the purpose of metal material fusion, and gap between the melting cylinder inner wall surface and the hollow shaft section outer surface can be formed large, because the agitation member 21 also does not melt by shearing heat, making thereby easier to accumulated molten metal material for several shots that was assumed to be difficult in case of adopting a screw, and further improving the molten metal material temperature maintenance effect.

Molten metal material after weighing is pressured by the advance displacement of the injection plunger 30, drives the cold plug blocking the nozzle member 47 nozzle port, passes through the hot runner leading from the aforementioned nozzle touch block 45 to inside the nozzle member 47, and injection charged in the mold 7 cavity.

In the course of weighing to injection, molten metal material equal of superior to the liquid phase line temperature is cooled down to semi-molten state while passing through the hot runner 53 and being injection charged in the die 7 as the nozzle touch block 45 and the nozzle member 47 are heated to and kept at a temperature equal or superior to the solid phase line temperature and equal or inferior to the liquid phase line temperature, and the injection molded magnesium mold becomes a product having a thixothropic composition, as a certain agitation is generated by a flow disturbed by the flow resistance.

A second injection molding method of the present invention consists in setting the temperature of all of the aforementioned melting cylinder 11, nozzle touch block 45 and nozzle member 47 is set so that the molten metal material temperature becomes equal or superior to the solid phase line temperature and equal or inferior to the liquid phase line temperature, heat melting the metal material to a semi-molten state in this temperature range and, at the same time, agitating to the thixothropic state by said agitation member 21, and weighing and injection charging into the aforementioned die 7 by the injection plunger 30 displacement all the way keeping this state.

In any of the aforementioned first and second injection molding methods, molten metal material is agitated continuously by the rotation of the aforementioned agitation fins 24, 24 whether in weighing or injection process, because the aforementioned agitation member 21 and the injection member 22 are separate ones inside the melting cylinder 11, thereby allowing to homogenize molten metal material in the melting cylinder, even when new metal material is supplied continuously or discontinuously into the melting cylinder 11.

It is unnecessary to make a large diameter injection rod as the conventional screw taking the rotation torque into consideration, because the injection member 22 does not rotate for the purpose of metal material fusion, and gap between the melting cylinder inner wall surface and the hollow shaft section outer surface can be formed large, because the agitation member 21 also does not melt by shearing heat, making thereby easier to accumulated molten metal material for several shots that was assumed to be difficult in case of adopting a screw, solving the temperature irregularity of semi-molten metal material, and allowing to injection molding easily thixothropic state metal molds more excellent in molding accuracy that the conventional molding methods.

What is claimed is:

1. An injection molding method of metal mold, comprising steps of:

supply continuously or discontinuously granular metal material in a cylindrical fusion vessel having a required length of weighing chamber communicating with a nozzle port at an extremity section, including rotatively an agitation means inside, and where an injection means whose extremity section is formed into an injection plunger is inserted retractably into a center section of this agitation means, for engaging slidably said injection plunger into the weighing chamber, heat melting the metal material to a temperature equal or superior to the liquid phase line temperature by an external heat and, at the same time, accumulating in the fusion vessel by homogenizing by the aforementioned agitation means, injecting and filling a die by cooling the metal material to a temperature equal or superior to the solid phase line temperature and equal or inferior to the liquid phase line temperature in the course from a feed into the weighing chamber by the retraction of the aforementioned injection plunger to the injection and filling of the die, and forming the metal material into a metal mold having a thixothropic structure.

2. An injection molding method of metal mold, comprising steps of:

supply continuously or discontinuously granular metal material in a cylindrical fusion vessel having a required length of weighing chamber communicating with a nozzle port at an extremity section, including rotatively an agitation means inside, and where an injection means whose extremity section is formed into an injection plunger is inserted retractably into the center section of this agitation means, for engaging slidably said injection plunger into the weighing chamber, heat melting the metal material to a temperature equal or superior to the solid phase line temperature and equal or inferior to the liquid phase line temperature by an external heat and, at the same time, accumulating in the fusion vessel by agitating and maintaining melt metal material in a semi-melt state (thixothropy state) by the aforementioned agitation means, sending a part of this semi-melt state metal material into the weighing chamber by the retraction of the aforementioned injection plunger, injecting and filling by advancing the injection plunger keeping the semi-melt state event after the weighing, and forming into a metal mold having a thixothropic structure.

* * * * *

UNITED STATES PATENT AND TRADEMARK OFFICE

CERTIFICATE OF CORRECTION

PATENT NO. : 6,405,784 B2
DATED : June 18, 2002
INVENTOR(S) : Kiyoto Takizawa et al.

It is certified that error appears in the above-identified patent and that said Letters Patent is hereby corrected as shown below:

Column 5,
Line 6, "45" should read -- 45° --.

Signed and Sealed this

Twenty-first Day of October, 2003

JAMES E. ROGAN
*Director of the United States Patent and Trademark Office*